United States Patent [19]

Lowry et al.

[11] Patent Number: 4,662,431

[45] Date of Patent: May 5, 1987

[54] CONTINUOUS METAL CASTING APPARATUS

[75] Inventors: Hugh R. Lowry, Fairfield, Conn.; Robert T. Frost, Berwyn, Pa.

[73] Assignee: General Electric Company, Bridgeport, Conn.

[21] Appl. No.: 506,765

[22] Filed: Jun. 22, 1983

Related U.S. Application Data

[60] Division of Ser. No. 454,600, Dec. 30, 1982, which is a continuation-in-part of Ser. No. 430,830, Sep. 30, 1982.

[51] Int. Cl.[4] ..... B22D 27/02

[52] U.S. Cl. ..... 164/503

[58] Field of Search ..... 164/466–468, 164/498–500, 502–504, 148.1, 147.1

[56] References Cited

FOREIGN PATENT DOCUMENTS 48-5413 2/1973 Japan ..... 164/502

*Primary Examiner*—Kuang Y. Lin

*Attorney, Agent, or Firm*—Charles W. Helzer; Arthur E. Bahr

[57] ABSTRACT

Apparatus for producing dense homogeneous metal cast in long lengths by introducing liquid metal into the lower portion of a casting vessel in the presence of an elongated upwardly-traveling alternating electromagnetic levitation field that provides a levitation ratio of from 75% to 200% of the weight per unit length of the liquid metal. The apparatus provides cooling for solidifying the metal while moving upwardly through the field, and a withdrawal mechanism for removing solidified metal product from the upper portion of the field. The electromagnetic field producing means is designed to establish an alternating electromagnetic field having a frequency at or near a value $F=36\rho/D^2$ where F is the frequency in kilohertz, $\rho$ is the resistivity of the liquid metal column in micro-ohm-centimeters and D is the average diameter of the solidified metal rod product in millimeters.

8 Claims, 8 Drawing Figures

CONTINUOUS METAL CASTING APPARATUS

This is a division of application Ser. No. 454,600, filed Dec. 30, 1982. Application Ser. No. 454,600 is a continuation-in-part application of U.S. application Ser. No. 430,830 filed Sept. 30, 1982 for a "Continuous Metal Casting Method, Apparatus and Product-"—Hugh R. Lowry and R. T. Frost, Inventors and assigned to the General Electric Company, the assignee of this application.

TECHNICAL FIELD

The present invention relates generally to the metal melting and solidification art and is more particularly concerned with a novel continuous casting apparatus for producing metal articles of long length, with a unique apparatus implementing that method, and with the resulting new products.

BACKGROUND OF THE INVENTION

Continuous casting has long been one of the more active areas of innovation in the metallurgical field and as a result a relatively large volume of patent and other technical literature has developed and continues to grow pertaining to the art of continuous casting. For a variety of reasons, however, comparatively very few of the concepts set out in the voluminous prior art have materialized in commercial form. The continuous casting systems for metal that have reached such status have usually involved the use of some type of mechanical contacting mold to contact, contain and shape the molten metal while it is solidifying. These molds take the form of casting wheels and casting belts and may in the case of the so-called "dip-forming" process take the form of seed rod which is in effect an internal mold.

As will be developed in more detail below, the present invention involves as a central feature the use of an alternating electromagnetic levitation field to support and contain out of continuous contact with the containing surface of a casting vessel an upwardly moving column of molten metal and eliminates the necessity for the casting wheel, the casting belt, the seed rod or other contacting molds now used in the industry. In addition to simplifying the continuous casting of metals forming and other commercial production systems, the apparatus of this invention opens the opportunity of making small to moderate quantities of copper, brass, nickle and other metallic rods by continuous casting instead of by the more expensive billet casting and hot rolling processes presently in general use.

With generally the same objectives in view, others have proposed the use of an electromagnetic mold to contain a metal melt pool on top of a downwardly moving ingot while the outer lateral portions of the pool are being solidified. This general departure is described in U.S. Pat. No. 3,467,166 (Getselev, et al) and is further developed in U.S. Pat. No. 3,605,865 (Getselev); U.S. Pat. No. 3,735,799 (Karlson); U.S. Pat. No. 4,014,379 (Getselev); and U.S. Pat. No. 4,126,175 (Getselev). In each instance, accretion is longitudinal, melt being delivered semi-continuously or continuously by gravity flow on the upper end of the descending ingot. One of the more serious drawbacks of this approach is the fact that the "fail safe" characteristic of casting upwardly is absent. Thus, in the event of an unexpected electric power failure, molten metal will spill out of the downward casting apparatus instead of merely running back, as in this invention, into the holding vessel. In addition, the melt overflow and breakout possibilities in downward casting require constant careful control of both the melt feed rate and the ingot removal rate. Moreover, these rates are drastically limited by a heat exchange problem which consequently diminishes the commercial potential of this special type of continuous casting.

According to another recent departure described in U.S. Pat. Nos. 3,746,077 (Lohikoski, et al) and 3,872,913 (Lohikoski) assigned to Outokumpo Oy, molten metal is either hydrostatically forced or pulled by vacuum upwardly into an open-ended, vertically-disposed mechanical mold as freshly-formed and cooled cast product is discontinuously and intermittently removed from physical contact with the upper end of the mechanical mold which contains the molten metal. In this way, the fail-safe feature is gained but only by accepting the major shortcomings of the external contact mold.

In Japanese patent application No. 5413/1973 published Feb. 16, 1973, Kenji Chijiiwa—Inventor, a continuous casting method and system is disclosed in which molten metal is supposed to be drawn upwards (lifted) from its reservoir by means of an electromagnetic pump. In this system the electromagnetic pump alledgedly is employed as an element in an overall feedback control system for regulating the rate of production of cast metal by continuously adjusting the pumping rate of the electromagnetic pump. The system has not been used commercially since its conception in September, 1970.

SUMMARY OF THE INVENTION

By virtue of the inventions and discoveries set forth in general terms immediately below and described in detail in reference to the accompanying drawings, the advantages stated above and others of importance to be described can be consistently obtained in continuous metal casting production operations. Further, these results are obtainable in the production of copper and other metal rods which can be rolled, annealed and drawn in the usual manner to produce wire. Still further, no economic penalty is imposed, but, on the contrary, these inventions and discoveries enable substantial production cost savings in certain product lines. By way of example, these inventions enable production of welding rods and other products in which grain size is not of primary importance by continuously casting directly to final desired size. As still another important advantage, this invention is generally not subject to compositional limitations, being applicable to copper rod production from high as well as low-oxygen content copper and to the production of rods and other long length forms of other metals and alloys including, but not limited to, aluminum, aluminum-base alloys, copper-base alloys, steel and the like.

This invention centers in the basic new concept of continuously casting upwardly by moving a liquid metal column into and through a forming zone defined by a casting vessel in which it is progressively cooled and solidified while being subject to an electromagnetic field which reduces the force required to remove the resulting cast product from the forming zone. This important novel effect of the electromagnetic field is accomplished in accordance with this invention by levitating and by maintaining the molten metal column out of continuous pressure contact with the walls of any containing vessel throughout the greater part of its length and particularly in that portion of it in the region where solidification is occuring. Levitation is accomplished by means of electromagnetic upwardly traveling waves applied in the preferred practice of this invention so that a major portion of the column length is maintained out of continuous pressure contact and hence essentially weightless throughout the casing operation. The levitating and maintaining effects are employed simultaneously so that a column of molten metal is established and maintained essentially weightless and out of contact with physical mold structure throughout the major part of its length. Thus the electromagnetic means performs both the lifting function and maintaining out of contact function.

It will be understood that there are important advantages associated with this basically new departure from prior practice and that electromagnetic levitation opens the opportunity for high production rates. This is achieved by virtue of the fact that inasmuch as the metal column is essentially weightless, it is not necessary to cool the freshly solidified portion of the metal product to any great extent in order to develop strength enough in it to support the weight of the metal below and also to withstand the tensile forces involved in overcoming mold friction in removing the product from the forming zone. In other words, the work necessary to withdraw the solidified metal product from a mold is very considerably diminished in this mode of operation because that work is a function of the mold-casting friction and this friction is proportional to the compression force at the interface. In the practice of this invention the compressive force is disappearingly small because of the weightless condition of the molten metal of the column and the consequent pressureless contact of the column with any mold surfaces (i.e. reduced hydrostatic head to substantially zero value). A principal advantage of electromagnetic levitation is thereby obtained without impairment of the heat exchange effectiveness of the physical casting vessel, there being in our preferred practice no presence of a significant space or gap between the physical casting vessel and the molten metal column throughout the greater part of the length of the latter which would impair good heat transfer between the sides of the mold and the molten metal column. The force required to remove the freshly solidified product and advance the molten metal column through the solidification zone is diminished materially by elimination of frictional and adhesional forces due to the weightless condition of the molten metal. Further, in respect to heat exchange effectiveness, it is possible to achieve good heat transfer by establishing the value of the levitating electromagnetic field so as to minimize the width of the gap between the molten metal column and the surrounding physical casting vessel.

An additional advantage is that levitation can be readily established and maintained under close control over a wide range of power input conditions. We have surprisingly discovered that levitation in the above described manner has a remarkable self-regulating characteristic, the line speed and levitating forces being interrelated in their operating effects. With the levitation field fixed at a desired value, an increase in upward travel rate (line speed) of the molten metal column results in a reduction in its cross-sectional size and consequent decrease of the electromagnetic lifting force applied to the column. As the upward rate then slows and the cross-section of the column consequently increases, the lifting force increases so that while the system may exhibit a slight hunting tendency, it will never be far from equilibrium and the product will be substantially uniform in cross-sectional size and shape.

As generally indicated above, we have further found that this new continuous casting apparatus in preferred as well as alternative modes, is broadly applicable to metals, metal mixtures, metal alloys and indeed to all electrically-conductive molten materials that can be solidified by the extraction of heat. Another closely related unexpected discovery is that under the condition of weightlessness which corresponds to essentially zero hydrostatic head, there is enough induced eddy current flow in the liquid metal column and consequent stirring of the liquid of the column as solidification proceeds apace with column travel through the levitation zone that a high degree of homogeneity exists in the cast product apparently as a result of the electromagnetic stirring in those metal mixtures exhibiting marked selective segregation and solidification tendencies.

Broadly and generally described, the apparatus of this invention provides the steps of forming an elongated, upwardly extending, alternating electromagnetic field, introducing liquid metal into the lower part of the field, solidifying the metal while moving upwardly through the field, and removing solidified metal product from the upper part of the field.

As previously indicated, in preferred form, the apparatus according to this invention, briefly described, provides means for continuously casting in accordance with the steps described immediately above and particularly the step of electromagnetically levitating the liquid metal in the field to the extent that a major part of that metal is essentially weightless and in pressureless contact with the surrounding physical mold structure.

Likewise briefly described, the apparatus described broadly and generally above, provides means for electromagnetically levitating a major part of the liquid metal to essentially weightless condition and at the same time electromagnetically maintaining the weightless liquid metal out of contact with lateral support structure.

Again in preferred practice of the invention, the levitation effect is such that at least part of the liquid metal column is substantially without hydrostatic head, that is, it is essentially weightless. The lifting force applied to move the column upwardly out of the forming zone is provided by means of a starting rod joined in the initial stage of the process to the liquid metal column which freezes in contact with the lower end of the rod. Withdrawal upwardly of the starting rod and of subsequent progressively solidified portions of the cast body is accomplished by suitable means as the lower end of the liquid metal column is continuously formed in stable maintenance of the continuous casting process.

In the apparatus for practicing the invention the length of the electromagnetic field is suitably greater, and preferably considerably greater, than the diameter of that field and the length of the levitated column is greater than its diameter.

The new apparatus of this invention preferably an elongated tubular casting vessel disposed in upright position to receive liquid metal for solidification, means for delivering liquid metal into the lower portion of the vessel, heat exchange means associated with the vessel for cooling and solidifying the liquid metal therein, means for removing solidified metal from the upper portion of the vessel, electromagnetic field producing means disposed around the vessel along a portion of its length and means for maintaining the electromagnetic field set at an established value during the course of a run. The electromagnetic field producing means may include a plurality of electromagnetic coils for connection to successive phases of a polyphase electric current source to produce an upward lifting effect in a column of liquid metal in the vessel. By "lifting effect", we mean that there is a continuous column of liquid metal urged upwardly into contact with the lower end of the forming product rod. In this way, voids and piping flaws are avoided. More in detail, the apparatus includes a crucible to contain a bath of molten metal communicating with the lower end of the casting vessel and also includes means associated with the crucible to form and move a column of liquid metal upwardly into the casting vessel to a level above the lower end of the levitation means. In preferred practice, the column forming means takes the form of a hydrostatic pressure source which operates to displace liquid metal to form and maintain the column.

The novel products of this invention, likewise generally described, are long metal bodies which are fully dense and of substantially uniform diameter and constant composition throughout in each instance. In their as-cast condition, these bars, rods and the like have portions with shiny, rippley, slightly wavy surfaces attributable to the fact that before, during and just after solidification the metal of which they are formed is electromagnetically maintained out of contact with lateral support structure, and also due to the fact that the liquid metal at the solidification front is constantly stirred by induced eddy currents. Again, in preferred practice, the product may suitably be a rod of a composition which tends strongly to phase separation, the induced eddy currents resulting in a high degree of dispersion of the phases.

In carrying out this invention, it is found that an average difference in diameter in rod held in levitation and that which physically contacts the tube is about one thousandths of an inch. This together with the unique surface configuration verifies that the solidification of the rod product occured out of continuous pressure contact with the cooling tube surface.

BRIEF DESCRIPTION OF DRAWINGS

Those skilled in the art will gain a further and better understanding of this invention from the following detailed description taken in conjunction with the drawings forming a part of this specification, in which.

DETAILED DESCRIPTION OF THE INVENTION

Figure 1:
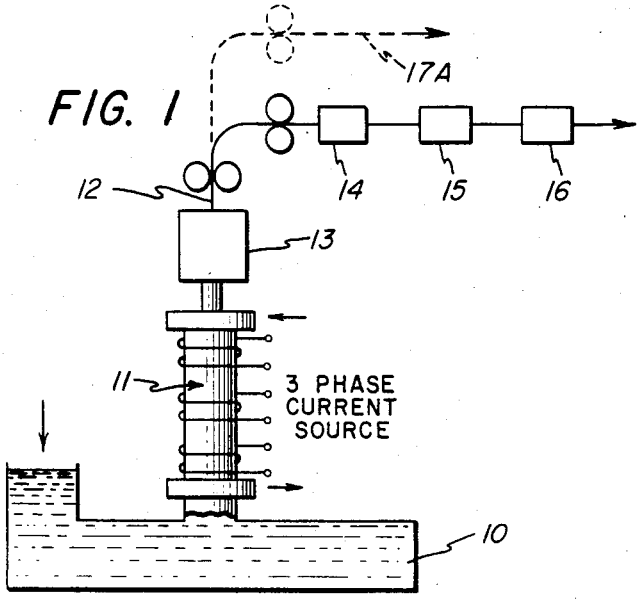
FIG. 1 is a diagrammatic view in elevation of apparatus embodying this invention in preferred form in combination with hot rolling apparatus.

As shown in FIG. 1, molten metal to be cast is contained in a holding furnace (not shown) from which it is delivered into casting crucible 10 as required to maintain the desired level of liquid metal within casting assembly 11. The casting assembly is mounted on and extends vertically upwardly from crucible 10 to an open upper end through which freshly cast rod product 12 is discharged into cooling chamber 13 from which it is transferred to tandem hot-rolling stations 14 and 15 and then finally cooled and coiled at coiling station 16. Alternatively, rod 17A is cast directly to final desired size for use. Metal melt is displaced from crucible 10 as a liquid metal column into casting assembly 11 by gravity flow from the holding furnace which delivers molten metal into crucible 10 at intervals or continuously as necessary during the continuous casting process. In preferred practice of this invention, column 20 (FIG. 2) of liquid metal is thus initially established and thereafter maintained at a level above that at which electromagnetic traveling wave levitation becomes effective to reduce and even eliminate the column hydrostatic head. In other words, the upper end of column 20 at the outset is brought within the lower portion of assembly 11 where at least the upper part of column 20 will become essentially weightless when the levitating apparatus of the casting assembly is connected to its electric power source.

Casting assembly 11 includes an open-ended heat exchanger and levitator tube 25 which is of refractory material secured to crucible 10 to receive liquid metal therefrom for solidification and eventual discharge as cast product from its upper end into cooling chamber 13.

Figure 3:
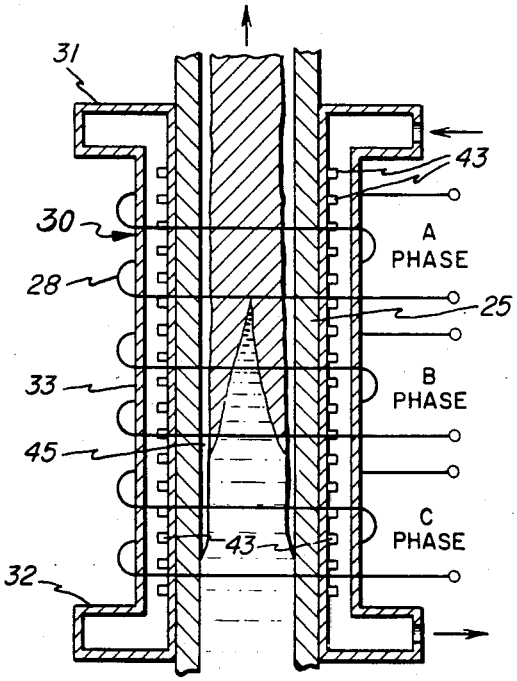
FIG. 3 is an enlarged, cross-sectional, semi-schematic view of the casting vessel of FIG. 2 illustrating a preferred form of practicing the invention.
Figure 5:
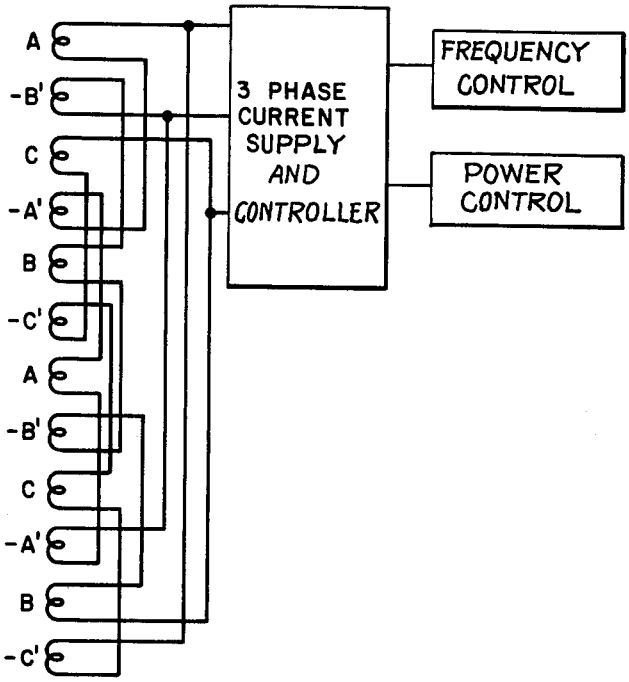
FIG. 5 is a functional block wiring diagram of the electric power supply for the levitation coil such as may be employed in the assembly of the apparatus of FIGS. 1–4.
Figure 6:
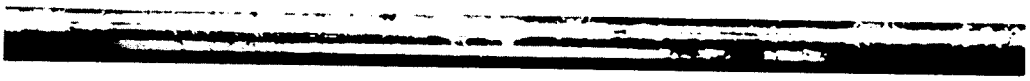
FIG. 6 is a photograph of a copper rod produced in accordance with the preferred practice of this invention.

For example, twelve coils diagrammatically indicated at 28 in FIG. 3 are disposed in vertical spaced relation around levitator tube 25 as windings arranged substantially normal to the tube axis and are connected in groups of three to successive phases of the polyphase electric current source as shown in FIG. 5 to create a magnetic field which will induce currents in the liquid metal in tube 25 resulting in an upward lifting effect upon the metal being cast. This six-phase levitator thus is operable to produce a progressive upwardly traveling wave which will move at a speed proportional to the distance between successive closed flux loops and the frequency of excitation. Coils 8 constituting the heart of the levitator means are arrayed vertically along the length of the levitator tube so that liquid metal and solidified metal product in all but the lowermost section of tube 25 can be levitated throughout the casting operation to the desired extent, preferably substantially to weightlessness during solidification. The portion of tube 25 surrounded by coils 28 thus defines the solidification zone of the apparatus.

An experimental model of this invention apparatus used to produce continuously cast copper, aluminum and bronze rods in demonstration of operability of the present process and apparatus had a levitation section of 36 turns of copper tubing wound at a pitch of six turns per inch giving an overall levitation section of six inches. The twelve coils were each energized 60 degrees in phase from its immediate neighbors and the section was effectively two wave lengths long. The diameter of the levitated metal columns was 22 mm and the column was maintained without acceleration (i.e., the levitation ratio was essentially unity) at a frequency near 1200 Hertz as the total DC power supplied to the motor-alternator AC levitator power source ranged from approximately seven to ten kilowatts. The heat exchanger illustrated in FIG. 4 was employed.

Figure 2:
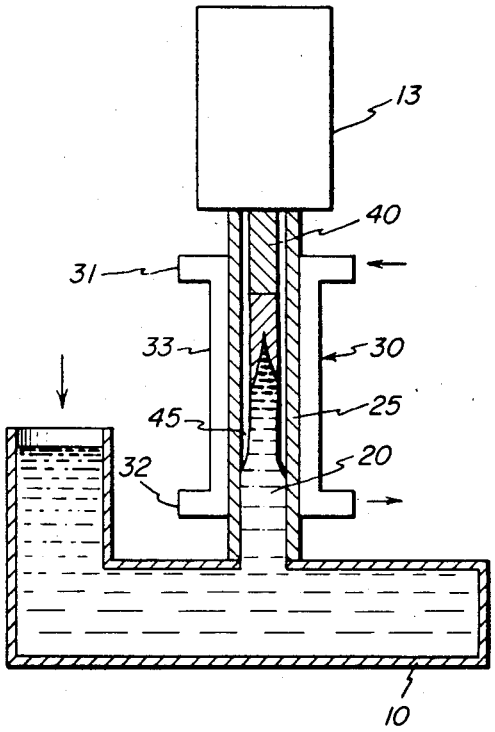
FIG. 2 is a schematic diagram in elevation of the casting assembly of the apparatus illustrated in FIG. 1.

While heat exchangers of a variety of designs and construction can be used with apparatus of this invention, the one best suited for this purpose and consequently our preference in this combination is that designated as 30 in FIGS. 2 and 3 of the drawings and is of fabricated sheet metal construction comprising upper and lower annular plenums 31 and 32 and a cylindrical section 33 fitted around levitator and heat exchanger tube 25 in contact with the annular outer surface thereof. Liquid coolant, suitably tap water, is continuously delivered from a source (not shown) into upper plenum 31 and flowed through section 33 throughout the metal casting operation and is withdrawn through lower plenum 32 to a drain carrying with it the heat absorbed through tube 25 from the liquid metal therein and the freshly solidified metal product therein. Coils. 28, as illustrated in FIG. 3, are disposed outside the central section of the heat exchanger, extending substantially from one plenum to the other in uniform spaced relation and closely spaced radially around the heat exchanger. A suitable material of construction of heat exchanger 30 is stainless steel because of the corrosion resistance and heat exchange effectiveness of such alloys.

In carrying out the invention, crucible 10 is charged with melt of a metal such as copper to be continuously cast in the production of articles of long length such as rod. Thus, as a preliminary step, the metal is melted and delivered into crucible 10 from the holding furnace to establish liquid metal column 20 with its upper end within the levitation portion of casting assembly 11. Starter rod 40 is introduced through the upper end of tube 25 to bring the lower end of the rod into contact with the top of the liquid metal column. With tap water running at full velocity through the heat exchanger, an upper portion of the liquid column is solidified in contact with the rod. Rod 40 and accreted rod end is then withdrawn upwardly from tube 25 at approximately the rate of formation of solid rod. The liquid column is maintained essentially weightless at least over most of its length and thus in essentially pressureless contact with tube 25 in this situation by operation of the levitator means and the operation is maintained on a continuous basis, producing a continuous length of metal rod, portions of which have a smooth, shiny, slightly wavy surface and uniform fully dense character throughout. This rod is carried through chamber 13 where water sprays reduce its temperature to the point at which it is in condition for final cooling and coiling with or without intermediate hot rolling.

As the level of liquid metal column 20 falls during the process, additional melt is delivered by gravity flow into casting crucible 10 so that the casting operation is continued without interruption.

The invention has been successfully demonstrated through use of apparatus in a number of experiments involving a variety of metallic materials. In particular, aluminum, copper and a bronze alloy have been cast in rod form in operations carried out essentially as described in detail immediately above. In each instance, the rod product was uniformly about 2 cm in diameter and was fully dense and of uniform composition throughout and portions had a smooth, shiny and slightly wavy surface. Electric power input to the levitator, however, was varied in accordance with the differences between the casting materials so as to match approximately the force of levitation to the weight of the levitated material, that is, to establish and maintain substantially zero acceleration levitation condition.

With regard to levitation, the liquid metal column is accelerated upwards if the levitation force is greater than the weight force and this results in a reduction in the lifting force as a consequence of the reduction of the cross-section of the column caused by the greater levitation force, while the opposite is the case when the lifting force is less than the weight force. While the full effect of the levitator means applies to a large part of the length of the liquid metal column and the solidified rod product within the levitator tube, the parts of the column in the lower and upper extremities of the levitator tube, where levitation forces average only about one half of those above, are supported, respectively, by the pressure head provided to raise the liquid column to initial height and by the lifting force applied through starter rod 40. Thus, as the liquid column is being established, a small upward acceleration is provided by those lower end region levitation forces and as the liquid metal column moves slowly upwardly an axial distance to a point about equal to the radius of the levitation coils, it enters fields strong enough to establish and maintain the column in an essentially weightless condition so that its contact with the levitator tube becomes substantially pressureless. By pressureless, it is meant that there is no substantial continuous pressure contact between the outer surface of the liquid metal column and the interior surrounding surfaces of the casting vessel and the liquid metal is without substantial hydrostatic head in the critical solidification zone so that frictional and adhesive forces as well as the force of gravity acting on the solidifying metal column are reduced to a minimum in this zone.

In the interest of limiting the size of the casting equipment and particularly the levitator assembly and also minimizing the power input requirements to maintain the liquid column through the solidification stage, maximum heat exchange effectiveness is desirable and to this end the heat exchanger described above provides in effect a condition approaching a water quench by effectively enveloping the rising liquid metal column in a rapidly-flowing, turbulent, but fairly small cross-sectional annular stream of liquid coolant. The heat exchange between metal column 20 and surrounding graphite tube 25 bearing against the cylindrical surface of the stainless steel inner wall of the heat exchanger assembly provides a highly efficient heat transfer capability. In the illustrated version of this heat exchanger that capability is further enhanced by short internal annular ribs 43 which serve as barriers to laminar flow, causing turbulence in the coolant liquid traveling downwardly through the heat exchanger from upper plenum 31 to lower plenum 32.

While theory imposes virtually no limit upon cross-sectional size of the products cast by the method of this invention, prevailing practical considerations fix the as-cast rod diameter range between about 5 mm and 50 mm, our own preference in the case of copper rod being 8 to 30 mm. Hot rolling will then result in the desired rod diameter and fine grain structure required for wire drawing. In any event, however, the inside diameter of levitator tube 25 and the operating parameters are selected so that in accordance with preferred practice, there is a minimum annular gap between the liquid metal of column 20 and tube 25. This is true below the point where solidifcation of the liquid metal results in shrinkage of the column cross-sectional area although such shrinkage is quite small. The gap indicated at 45 in FIGS. 2 and 3 is schematic and not intended as an accurate representation of the location or of the dimensions of the annular gap. This gap if allowed to become too large due to the containment effect of the upwardly traveling levitating electromagnetic field, could seriously impair effective heat transfer between the liquid metal column and tube 25 since there is a strong inverse relationship between field strength and heat removal rate. Consequently, the levitation field strength should be adjusted at the start of a casting operation to provide pressureless contact as defined above with minimum gap spacing consistent with good heat transfer. Then the field strength should be maintained at this setting and should not be changed during the casting operation even though rate of movement (line speed) of the liquid metal column through the levitator tube might be changed. From the standpoint of a practical continuous casting process, the temperature of the solidified rod is very critical and must be maintained within a relatively narrow range. For example, if the cast rod is copper and is much above 1000 degrees Centigrade (white hot) it will be too weak to support itself and transmit the tensile forces needed to move the rod from the casting operation to the cooling chamber 13 and rolling mill. On the other hand, if the rod temperature is less than about 850 degrees Centigrade, it will be too cold for the "hot" rolling needed to convert the large grains formed during casting into the fine grain, homogeneous structure needed for subsequent cold drawing (or cold working) of metal. Because of the above-noted strong inverse relationship between field strength and heat removal rate, it is important therefore, that the field strength not be changed during the course of a run even though line speed might be changed since it could cause unacceptably large variations in emerging rod temperature.

In runs during which molten copper was levitated, cooled, and withdrawn continuously for limited periods, it was noted that there was an increase in rod temperature of from 300–400 degrees Centigrade caused by increasing the levitation field strength when rod speed and all other factors were kept constant. This confirms computer simulations and observations on liquid gallium that the effective column diameter and pressure against the walls of the heat exchanger changes with levitation field strength. Even a very slight change in column diameter and sidewall pressure will have a profound effect on the flow of heat from the copper column through the wall of heat exchanger and, hence, cause the observed large changes in rod temperature. There was no observed (or expected) effect of levitation field strength on casing speed.

An experiment was conducted for the purpose of testing the capability of this new apparatus to produce castings of alloy having fine dispersion which otherwise have a tendency toward selective segregation and solidification of different components. An aluminum-bronze alloy was melted and at three different times cast in accordance with this invention using apparatus essentially as described above with the exceptions that liquid metal column 20 was established and maintained by displacement of melt from crucible 10 by piston action instead of by gravity flow from a holding furnace. Results of analyses of the alloy used to form the molten metal and of the three rod products are set forth in Table I from which it is apparent that within the accuracy of the sampling and analytical techniques used, the gross homogenity of the alloy composition was fully maintained.

TABLE I

| Element | Starting Material | Run 1 | Run 2 | Run 3 |
|---|---|---|---|---|
| Fe | 2.64% | 2.69% | 2.65% | 2.71% |
| Sn | .01% | .03% | .01% | .02% |
| Zn | .01% | .03% | .02% | .02% |
| Al | 10.35% | 10.12% | 10.02% | 10.05% |
| Mn | .49% | .76% | .68% | .72% |
| Si | .028% | .049% | .039% | .046% |
| Ni | 5.00% | 4.99% | 4.90% | 4.99% |
| Others | .03% | .03% | .03% | .03% |
| Cu | Rem | Rem | Rem | Rem |

Figure 4:
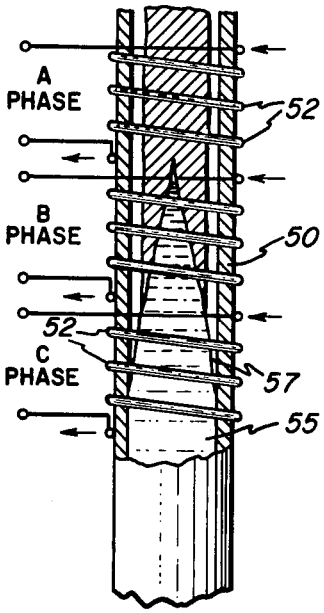
FIG. 4 is a view like that of FIG. 3 of alternative apparatus for practicing the invention and illustrates the combined effects of liquid metal column levitation and containment in the sense of maintaining a finite gap.

The apparatus of FIG. 4 is a subassembly comprising a levitator tube 50 and a series of twelve separate copper cooling tubes indicated at 52 coiled on tube 50 and spaced along the length thereof and connected separately to a source of coolant liquid such as tap water (not shown). Tubes 52 are also operatively connected in groups of three to successive phases of a polyphase electric current source such as shown in FIG. 5 for the upward lifting effect described above and so serve two essential purposes. Also, as in FIG. 3, the individual coil groups of FIG. 4 are represented by the letters A, B, C referring to the three phases of the FIG. 5 diagram illustrating the circuitry of the apparatus and its power source. Thus, this subassembly takes the place of levitator tube 25, heat exchanger 30 and twelve coils 28 in the FIG. 3 apparatus but in use as shown operates to provide both levitation and containment or mold functions. In other words, this apparatus is used in such a way that liquid metal column 55 like column 20 is maintained in a substantially pressureless contact and weightless condition throughout most of its length but unlike column 20 is over that same length maintained out of contact with tube 50, being separated therefrom by an annular gap 57 preferably of small radial dimension.

Cover gas not detrimentally reactive with the metal being cast is employed and may be delivered into space 57 in any desired manner. Our preference for this purpose in copper casting is nitrogen or a mixture of nitrogen, hydrogen and carbon monoxide produced by burning a rich mixture of natural gas and then separating and removing the $H_2O$ and $CO_2$ from the resulting gases.

Figure 7:
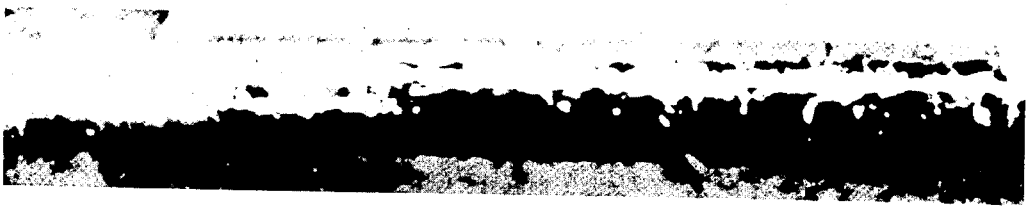
FIG. 7 is a close-up photograph of the bottom end of the copper rod of FIG. 6 showing the different surface characteristics discussed below.
Figure 8:
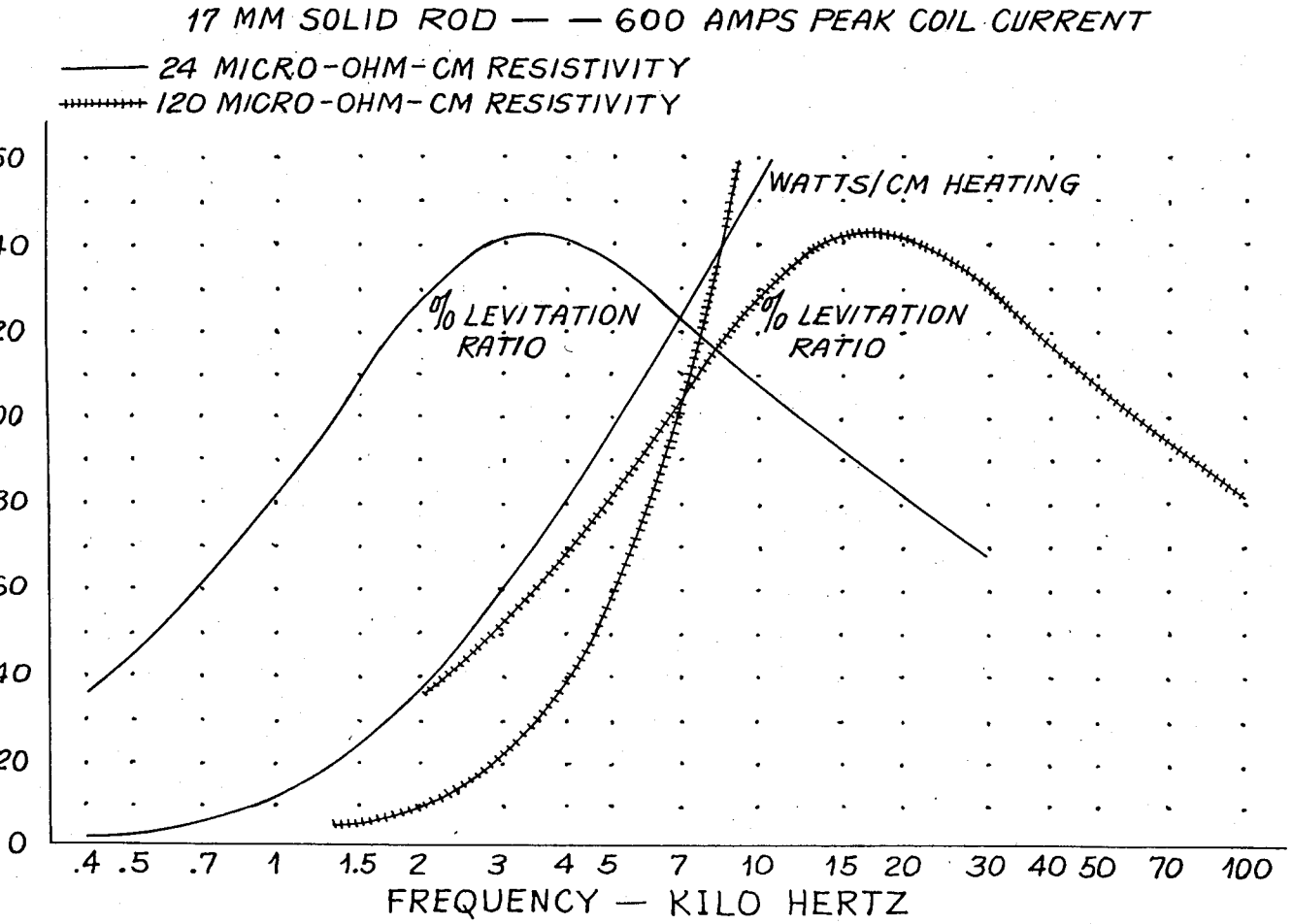
FIG. 8 illustrates curves for two different resistivity metals showing the variation in lifting force measured in percent levitation ratio with increasing frequency.

Cast copper rod product of this invention shown in FIGS. 7 and 8 was produced in accordance with the preferred practice of the invention method through the use of the FIG. 3 apparatus. In particular, the upward casting operation was carried out as described in reference to FIGS. 1–3, the electromagnetic levitation mode being used to maintain the liquid copper column weightless but in pressureless contact with the levitator tube throughout the upper portion of the column. The slightly wavy, smooth, shiny surface portions of the rod product is the result of keeping the liquid copper column in a weightless condition with essentially no hydrostatic head and not exerting substantial continuous pressure on lateral support structure at the point where the surface of the column was solidifying. It is also the result of the eddy currents induced in the solidifying copper by the levitating field. This fully dense product (8.9 by actual measurement and computation) was of apparently uniform composition throughout. The rod diameter closely approximated 16 mm which was the inside diameter of levitator tube 25 in which the rod was produced. The smooth dull band at the lower or left end of the rod is about 2 mils larger in diameter than the shiny, ripply surface portions, which shiny portions solidified while not in pressure contact with the levitator tube. This short, smooth dull band was produced at the lower end of the rod which solidified in a region of the heat exchanger below the region of effective levitation and the molten copper was, therefore, in pressure contact with the levitator tube. The difference in appearance of the portions in pressure contact and not in pressure contact are apparent.

In a continuous casting system employing the invention where the cast material is tandem hot rolled, it is very important that the temperature of the cast material be closely controlled. For copper the temperature of the cast shape must obviously be low enough (say 1020 degrees Centigrade) so that it has strength adequate to withstand the tensile forces applied to pull it from the casting chamber into the rolling mill. If the cast shape is bent while hot (for example, the 90 degree change in direction from a vertical casting mechanism into a horizontal rolling mill) it has been found the copper should not be hotter than about 950 degrees C. to 1000 degrees C. otherwise cracks will develop, especially if there are a few parts per million of sulfur in the copper. On the lower end, the copper must be red hot (above 750 degrees C.) so that the large "as-cast" grain structure will be broken up during hot rolling into the desired fine grain homogeneous structure. From a more practical aspect, the horsepower required to roll copper to a smaller diameter is dependent on the copper temperature, the hotter the rod the easier it is to roll. For this reason, in addition to metallurgical reasons and the necessity for the rod to remain hot as it passes through the various stands of the rolling mill, the temperature of copper entering the rolling mill is usually 850 to 950 degrees C.

In processes where molten copper is in continuous pressure contact with a graphite mold, there is rapid wear of the graphite. This is caused by copper adhering or being driven into surface cavities of the graphite and then the graphite surface is torn away when the solidified copper is pulled through the mold. In vertical downward casing machines the mold is often vibrated or oscillated upward and downward continuously to decrease mold wear. In the Outokumpu upcast system where copper solidifies under hydrostatic pressure in a water cooled graphite mold and the solid rod then jerked upward, the mold must be replaced every few hours because of the rapid wear. The effect of levitation field strength on life of the graphite lining of the heat exchanger is not known due to lack of data resulting from continuous runs lasting many hours or days. It is believed, however, that the condition where essentially pressureless contact of the copper to the graphite would minimize wear and still achieve close to the maximum possible heat transfer. This condition would occur when the upward levitation force per unit of length was greater than 75% of the weight per unit length of the liquid metal (i.e., a levitation ratio of 75%). Operating at a high levitation ratio (greater than 200%) is not felt to provide any benefits in terms of decreased wear on the graphite and could be detrimental in that heat flow rate (and hence maximum casting speed) would be unnecessarily decreased.

The almost 2:1 increase in levitation force on a copper column (at constant field strength) as it changes from a liquid to solid precludes controlling casting speed by changing the strength of the electromagnetic levitation field dynamically during the course of a run. A field strength just sufficient to move solidified rod upward would be insufficient to keep molten copper raised up and in contact with the rod. A field strength adequate to raise the molten copper would tend to accelerate the solidified copper away from the liquid copper. As stated above, the temperature of the cast copper must be held within the range of about 1000 to 850 degrees C. because of tensile strength and cracking problems above 1000 degrees C. and hot rolling problems below 850 degrees C. The profound inverse effect of levitation field strength on rod temperature would also preclude dynamically controlling casting speed during the course of a run with field strength since this could cause unacceptably large variations in emerging rod temperature. Further, a potentially unstable situation could develop if levitation field strength were used dynamically to control line speed of the liquid metal column during the course of a run. If the field strength is dynamically increased in an attempt to move the column faster, the heat removed per unit length of rod would be increased due to the shorter time in the heat exchanger/levitator tube. Both this phenomenon and the increase in temperature of the liquid column with increase in field strength noted previously, could result in a temperature increase in the levitated column. However, the resistivity increases with increase in temperature and the lifting force might then decrease. The net effect of increasing field strength could thus be contrary to the result desired. Decreasing the field strength dynamically in the course of a run on the other hand, could unduly reduce the upward flow rate of liquid copper to an extent that separation of the liquid column from the solidified product occurs.

From the above considerations, the conclusion is that the casing speed (i.e., line speed of the liquid metal column in the heat exchanger/levitator tube) in the process of the invention, should be controlled by the same method as in the long used and reliable Dip Forming Process—i.e., only by control of the drive motors in the rod removal mechanism that is synchronized with the rolling mill and coiler. The levitation field strength and excitation frequency should be established at a value calculated for the particular size and resistivity of the metal being cast to give a levitation ratio in the range between 75% and 200% and thereafter maintained at the set value through the course of the run.

In operation a practical process and system employing the invention would be started at a lower than normal line speed and higher than normal levitation ratio in order to insure reliable startup. After reaching steady state (2–3 minutes) the line speed would be increased manually in steps and the levitation field strength decreased in steps until close to a maximum casting rate (in terms of tons/hr conversion of molten metal to the cast shape) is achieved. The system is then maintained at this setting during the course of the run. Normally, the temperature of the emerging material would be monitored either visually or by a pyrometer.

As described above, a practicable upward moving continuous casting apparatus requires that friction and wear forces on the mold be reduced to prevent sticking and to allow the just-formed thin skin of solidified metal next to the heat removal means to remain in continuous motion. This in turn requires the hydrostatic pressure due to the liquid metal column lying above to be reduced essentially to zero by the action of electromagnetic levitation forces acting on the solidifying column. The consequent reduction in friction also results in lower wear and longer life for the inner liner of the heat exchanger.

Although in principle the electromagnetic levitator can use an arbitrary frequency of electrical excitation, detailed computer calculations based on a unique computer code development, and verified by experiments indicate the following: For practicable system, the excitation frequency must be chosen within a band which excludes conventional power frequencies in the neighborhood of 60 Hz and which becomes optimum at audio frequencies of the order of 1 kHz to several kHz, depending upon the electrical resistivity of the molten metal being cast.

The Lorentz force per unit volume for the solidifying liquid metal in a magnetic field which is continuously traveling in the upwards direction with velocity v relative to the metal is $$k=j\times B \tag{1}$$

where j is the electric current density and B is the magnetic induction. The $\times$ refers to vector multiplication.

For the polyphase levitator, such as shown in FIG. 3, in which each successive coil is excited with an alternating current whose phase is retarded by a fixed increment with respect to the preceding coil, the magnetic field pattern generated repeats itself over a length of the levitator in which the successive phase lags add up to 360 degrees. Because the field is alternating, this fixed field pattern propagates along the length of the levitator at a linear velocity $$v=F\lambda \tag{2}$$

where F is the excitation frequency and $\lambda$ the wavelength of the magnetic field pattern. $\lambda$ is simply the levitator length over which the successive coil phase retardations add to 360 degrees as mentioned above. For example, where the successive phase retardations are 60 degrees, $\lambda$ will be equal to the levitator length including six successive field coils.

According to the special theory of relativity, an electric field E will appear in the liquid metal of intensity $$E=(-v)\times B \tag{3}$$

where (−v) is the vertical velocity of the liquid metal with respect to the field.

This electric field will give rise to an electric current density j equal to $$j=E/\rho \tag{4}$$

where $\rho$ is the electrical resistivity of the metal. Combining equations (1), (3) and (4) gives $$k=[(-v\times B)\times B]/\rho \tag{5}$$

This triple vector product can be written in a more useful form as $$\rho k=v(B\cdot B)-B(B\cdot v) \tag{5'}$$

where the dots denote vector scalar products.

From equation (5') it will be seen that the Lorentz force has components both in the direction of v and B. Denoting the vertical lifting force density as $k_v$, and the angle between B and the vertical direction of v as $\theta$, results in:

$$\rho k_v=|v|B^2-|B|\cos\theta(|B||v|\cos\theta)=|v|B^2\sin^2\theta=|v|B_h^2=F\lambda B_h^2 \tag{6}$$

where $B_h$ is the horizontal component of B. Thus, it will be appreciated that the lifting force is due solely to the horizontal component of the magnetic induction vector. To compute the total lifting force on the solidifying rod, one must compute the average value of the right hand side of (6) and multiply by the rod volume within the levitator. Normally the levitator will encompass the entire length of rod in which the outer portion is reaching sufficient thickness and strength to prevent breaking and where it has shrunk sufficiently to prevent further sticking or friction with the heat exchanger liner.

At low frequencies, the field will extend through the entire interior of the solidifying metal, and equation (6) shows that in this frequency range the lifting force will be proportional to the frequency F. At high frequencies, however, the total field inside the liquid metal will be attenuated by the well known electromagnetic skin depth phenomenon. The horizontal field $B_h$ will decrease even more rapidly with frequency than the total field, due to the fact that a given field line penetrates the liquid metal less and becomes more nearly parallel to the rod axis. Thus, in equation (6), the average value of $B_h$ will drop rapidly with frequency above that frequency at which the electromagnetic skin depth becomes comparable to the rod radius. Thus there will exist a frequency at which the lifting force reaches a maximum.

FIG. 8 of the drawings shows results of computer calculations of lifting force for a 6 phase levitator of coil diameter 3.12 cm and length 15 cm operating on a 1.7 cm diameter column of molten copper of resistivity 24 micro-ohm-cm. Also shown are results for an alloy having an electrical resistivity 120 micro-ohm-cm. Curves for both lifting force and induced joule heating are shown. The ratio of lifting force to metal weight is denoted as the "levitation ratio" in percent. It can be seen that the levitation force at fixed coil exitation current is reduced considerably for frequencies far outside an optimum band or range of frequencies, which is different for the two metal resistivities. Thus, to achieve a levitation force equal to the copper weight to prevent sticking will require much higher coil excitations if the frequency is chosen outside the optimum band of frequencies. For example, if for copper the levitator is run at a frequency of 60 Hz instead of 1.5 kHz, the coil would have to be run at an excitation power 25 times greater at the lower frequency to achieve the same levitation force. In experiments with 1.6 cm diameter copper rod, coil excitation powers are typically 3 kw to achieve full levitation to prevent sticking. Levitation at 60 Hz would thus require $3\times25=75$ kw at the 60 Hz frequency. The corresponding coil currents would be raised from typically, 350 amperes to $350\times5=1750$ amperes. The design and construction of a polyphase levitator capable of handling this higher current presents many engineering problems, because of the large required conductor sizes. Although the coil heat dissipation can be reduced in this manner, the large conductor size would significantly increase the effective diameter of the levitation coils which in turn would require even higher excitations to achieve the required field strengths within the levitated solidifying rod. Examination of the joule heating curves shows that the power absorbed per unit rod length rises rapidly in the neighborhood of the optimum levitation frequency. This indicates that operation appreciably beyond the optimum levitation frequency can lead to electrical heating which could inhibit rod solidification, particularly for the higher resistivity metals.

Additional computer calculations for other rod diameters, with appropriately sized levitators, indicate that the optimum levitation frequency is given approximately by the formula $$F=36\rho/D^2 \quad (7)$$

where F is the frequency in kilohertz, $\rho$ the resistivity in micro-ohm-cm, and D the average rod diameter in millimeters.

Because of practical coil excitation current considerations, operation of the levitator at frequencies approaching an order-of-magnitude less than the optimum levitation frequency should be excluded. Accordingly, it appears that the optimum frequency range of operation is from such a minimum to an upper frequency not substantially greater than the optimum frequency F, which will be different for each metal resistivity and rod diameter as indicated by equation (7).

INDUSTRIAL APPLICABILITY

The invention describes an apparatus for continuously casting metal products by moving a liquid metal column into and through a solidification zone in which it is progressively cooled and solidified while being subjected to a levitating electromagnetic field which reduces the force required to remove the resulting cast products from the solidification zone.

Having described several methods and apparatus for continuously casting metal products in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. Continuous casting apparatus comprising an elongated casting vessel disposed in an upright position to receive liquid metal for solidification and having an open upper end, means for delivering liquid metal into a lower portion of the vessel, heat exchange means associated with the vessel for cooling and solidifying liquid metal therein, electromagnetic levitation field producing means disposed around the vessel along a portion of its length for producing a uniform upwardly travelling levitation magnetic field for reducing the hydrostatic head of the column and maintaining the liquid metal column in a substantially weightless condition while simultaneously producing a containment magnetic field for maintaining a predetermined dimensional relationship between the outer surface of the liquid metal column and the interior surrounding surfaces of the casting vessel, excitation current supply means coupled to said electromagnetic levitation field producing means for establishing and maintaining the value of the levitation and containment magnetic fields so that the cross-sectional dimensions of the liquid metal column is maintained out of continuous pressure contact with the sides of the casting vessel and precludes formation of a substantial gap between the outer surface of the column and the interior surrounding surfaces of the casting vessel thereby effecting optimum heat transfer between the liquid metal column and the casting vessel while simultaneously reducing frictional, adhesive and gravitational forces to a miniumm, means independent from said electromagnetic field producing means for moving the liquid metal column upwardly through the casting vessel, means for removing solidified metal product from the upper open end of the casting vessel, and control means for controlling the magnitude of the excitation current and hence the magnetic field strength produced by the electromagnetic levitation field producing means during initial start-up and running to set the levitation ratio produced by the apparatus between a range of levitation ratio values of from 75% to 200%.

2. The apparatus of claim 1 further including means for adjusting the frequency value of the frequency of excitation value of the electromagnetic field producing means over a range of values including an optimum frequency value $F=36\rho/D^2$ where F is the frequency in kilohertz, $\rho$ is the resistivity of the liquid metal column and D is the average diameter in millimeters of a solidified metal product produced by the apparatus.

3. The apparatus of claim 2 wherein the range of frequency values extends from a minimum frequency substantially no less than an order of magnitude less than the optimum frequency value $F=36\rho/D^2$ to a maximum value not substantially greater than the optimum value F.

4. The apparatus of claim 3 including a crucible to contain a bath of molten liquid metal communicating with the lower end of the casting vessel, and means associated with the crucible to establish and move a column of liquid metal upwardly into the casting vessel to a level above the lower end of the electromagnetic levitation field producing means.

5. The apparatus of claim 4 further including means for introducing a starting metal rod through the upper open end of the elongated casting vessel and joining the lower end of the starting metal rod to the upper end of the molten liquid metal column within the electromagnetic field of the electromagnetic levitation field producing means for use in removing solidified metal product from the upper portion of the vessel.

6. The apparatus of claim 5 further including means for controlling the rate of production of solidified metal product by controlling the rate of removal of the solidified metal product from the upper portion of the casting vessel.

7. The apparatus of claim 6 further including means for precooling the solidified metal product as it emerges from the upper portion of the casting vessel, means for rolling the product to a desired dimension, means for cooling the rolled product to an ambient temperature, and means for storing the cooled product.

8. The apparatus of claim 6 further including means for precooling the solidified metal product, means for cooling to an ambient temperature and means for storing the cooled product.

* * * * *

UNITED STATES PATENT AND TRADEMARK OFFICE

CERTIFICATE OF CORRECTION

PATENT NO. : 4,662,431

DATED : May 5, 1987

INVENTOR(S) : Hugh R. Lowry et al.

It is certified that error appears in the above-identified patent and that said Letters Patent is hereby corrected as shown below:

Column 1, cancel lines 4-11 and insert the following:

This is a division of U.S. patent application Ser. No. 454,600, filed December 30, 1982 which is a continuation-in-part application of U.S. patent application Ser. No. 430,830, filed September 30, 1982 that in turn is a continuation of U.S. application Ser. No. 165,421, filed July 2, 1980 for a "Continuous Metal Casting Method, Apparatus and Product" - Hugh R. Lowry and Robert T. Frost, Inventors and assigned to the General Electric Company, the assignee of this application. Application Ser. No. 454,600 is now U.S. Patent No. 4,414,285, issued November 8, 1983. Application Ser. No. 430,830 is now U.S. Patent No. 4,719,965, issued January 19, 1988. Application Ser. No. 165,421 is now abandoned. --

Signed and Sealed this

Twenty-ninth Day of November, 1988

*Attest:*

*Attesting Officer*

DONALD J. QUIGG

*Commissioner of Patents and Trademarks*